US008250718B2

(12) United States Patent
Greco

(10) Patent No.: US 8,250,718 B2
(45) Date of Patent: Aug. 28, 2012

(54) ZIPPER HOLE PUNCH TREATMENT

(75) Inventor: Charles G. Greco, Bardonia, NY (US)

(73) Assignee: Illinois Tool Works Inc., Glenview, IL (US)

( * ) Notice: Subject to any disclaimer, the term of this patent is extended or adjusted under 35 U.S.C. 154(b) by 399 days.

(21) Appl. No.: 12/562,335

(22) Filed: Sep. 18, 2009

(65) Prior Publication Data

US 2010/0122440 A1 May 20, 2010

Related U.S. Application Data

(60) Provisional application No. 61/115,611, filed on Nov. 18, 2008.

(51) Int. Cl.
*A44B 19/16* (2006.01)

(52) U.S. Cl. ..... 24/585.12; 24/400

(58) Field of Classification Search ..... 24/30.5 R, 24/399, 400, 388, 435, 585.12, DIG. 50; 53/412, 139.2, 133.1; 493/213, 214; 383/61.2, 383/61.3, 63, 64

See application file for complete search history.

(56) References Cited

U.S. PATENT DOCUMENTS

| | | | | |
|---|---|---|---|---|
| 5,273,511 | A * | 12/1993 | Boeckman | 493/195 |
| 5,906,438 | A | 5/1999 | Laudenberg | |
| 6,884,207 | B2 | 4/2005 | Pokusa | |
| 6,973,704 | B2 | 12/2005 | Cortigiano, Sr. | |
| 2004/0226148 | A1 * | 11/2004 | Haws et al. | 24/399 |

* cited by examiner

*Primary Examiner* — James Brittain
(74) *Attorney, Agent, or Firm* — McCarter & English, LLP

(57) ABSTRACT

The disclosure relates to a reclosable zipper for a package or bag wherein apertures are formed at periodic package-width intervals passing through the interlocking elements of the zipper profiles in order to minimize the mass of zipper material in areas where side seals of packages or bags will be subsequently formed. The otherwise interlocking elements upstream of, or at the trailing edge of, the apertures are deformed so as to prevent interlocking of the elements through a limited area. This allows a separator pin to pass through the area of the apertures and pass between the zipper profiles, eliminating or reducing the collision of the separator with the zipper profiles and subsequent potential damage to the zipper profiles.

20 Claims, 1 Drawing Sheet

ZIPPER HOLE PUNCH TREATMENT

This application claims priority under 35 U.S.C. §119(e) of U.S. provisional application Ser. No. 61/115,611 filed Nov. 18, 2008, the disclosure of which is hereby incorporated by reference.

BACKGROUND OF THE INVENTION

1. Field of the Disclosure

The present disclosure pertains to the punching of holes or apertures into the zipper of a reclosable package wherein a portion of the zipper profile is deformed, smashed or otherwise splayed to improve the opening characteristics of the zipper.

2. Description of the Prior Art

In the prior art, it is known to punch holes or apertures into a zipper to remove part of the interlocking profile. The removal of a portion of the zipper profile aids in the side seal creation in that a flat and hermetic side seal at the zipper area may be facilitated by removing the mass of material associated with the profile and leaving the web material of the zipper in place. However, when the holes or apertures are punched into a zipper web and a separator bar or pin is used to open the zipper of a package for pre-made opened zippered packages, the separator bar or pin may encounter the trailing end of the hole or aperture and a collision with the profile is created, thereby potentially damaging the profile.

OBJECTS AND SUMMARY OF THE DISCLOSURE

It is therefore an object of the present disclosure to provide a method and apparatus wherein apertures may be punched or otherwise formed in zipper profiles and a separator bar, pin, or similar device is used to separate in zipper profiles with little or no damage to the profiles.

This and other objects are attained by deforming or "smashing" the interlocking elements of the zipper profile at the trailing end of apertures or holes which are punched or otherwise formed in a zipper which is separated by a separator bar, pin, or similar device. This deformation or "smashing" of the interlocking elements disrupts the interlocking of the interlocking elements thereby resulting in the separator bar, pin, or similar device being more likely to separate the profiles without creating a collision or damage to the zipper.

The advantages typically achieved by this configuration include allowing double profile zippers with larger masses to run in the automated manufacturing machinery, lessening the web breakage of zippers, allowing faster operating speeds thereby resulting in more bags or packages per minute, and allowing a zipper with greater opening forces (i.e., profiles more tightly fastened with each other) to run in the automated manufacturing machinery.

BRIEF DESCRIPTION OF THE DRAWINGS

Further objects and advantages of the invention will become apparent from the following description and from the accompanying drawing, wherein.

DETAILED DESCRIPTION OF THE PREFERRED EMBODIMENTS

Figure 1:
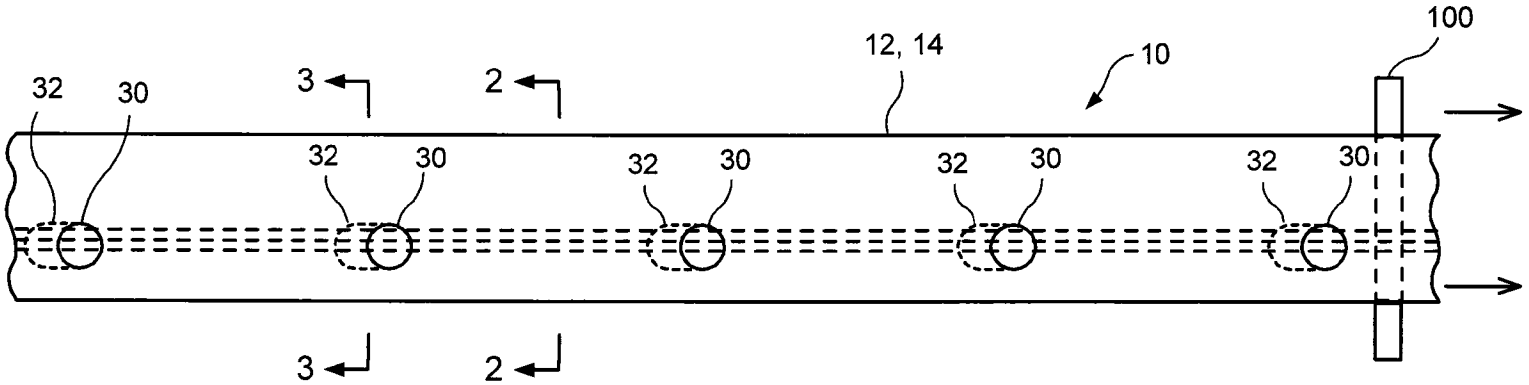
FIG. 1 is a schematic of a zipper with apertures or holes punched therein, being separated by a separator pin, and showing where the deformation in the zipper profile should be formed.
Figure 2:
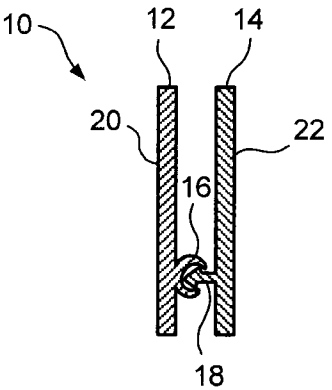
FIG. 2 is a cross-sectional view along plane 2-2 of FIG. 1, showing undeformed zipper profiles.
Figure 3:
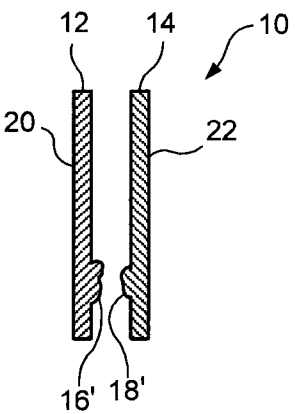
FIG. 3 is a cross-sectional view along plane 3-3 of FIG. 1, showing the deformed zipper profiles.

Referring now to the drawings in detail wherein like numerals indicate like elements throughout the several views, one sees that FIG. 1 is a schematic of the reclosable zipper 10 of the present disclosure. As shown in FIG. 2, reclosable zipper 10 includes first and second profiles 12, 14. First profile 12 includes first interlocking element 16 (configured as a female element) and first flange 20 extending therefrom, while second profile 14 include second interlocking element 18 (configured as a male element) and second flange 22 extending therefrom. Apertures or holes 30 are periodically formed in reclosable zipper 10 so as to pass through the interlocking elements 16, 18. Apertures or holes 30 are typically spaced at package-width intervals so that side seals of resulting packages or bags (not shown) can be formed over the apertures or holes 30 in order to facilitate a flat and hermetic side seal at the zipper area. Immediately upstream of apertures 30, areas of profile deformity 32 are formed. In other words, areas of profile deformity 32 are formed at the trailing end of apertures 30. As shown in the cross-sectional view of FIG. 3, in areas of profile deformity 32, deformed elements 16', 18' replace interlocking elements 16, 18 and are in a smashed, deformed, or splayed configuration so that deformed elements 16', 18' are not capable of interlocking with each other. Deformed elements 16', 18' can be formed in the same operation that punches or otherwise forms apertures or hole 30, or can be formed by a separate operation. The deformation can be caused by impact or heat, or some combination thereof. The machine-direction length of areas of profile deformity 32 may be exaggerated in FIG. 1. The machine-direction length of the areas of profile deformity 32 are chosen so as to be included within the side seals of subsequently formed packages or bags.

Reclosable zipper 10 is illustrated in FIG. 1 as running in the machine direction from left to right. Prior to encountering separator pin 100 (which is typically stationary), the first and second profiles 12, 14 are in an interlocked state. After passing separator pin 100, the first and second profiles 12, 14 are separated from each other by separator pin 100. When separator pin 100 encounters areas of profile deformity 32, the lack of interlocking between deformed elements 16', 18' allows the separator pin 100 to enter between deformed elements 16', 18', and subsequently, interlocking elements 16, 18 with minimal, if any, collision between the separator pin 100 and the reclosable zipper 10, resulting in reduced or eliminated tearing of the reclosable zipper 10.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper including:

a first profile including a first element;

a second profile including a second element;

wherein the first element can interlock with the second element;

apertures passing through the zipper; and areas of deformity formed adjacent to the apertures wherein the first element and the second element are deformed thereby preventing interlocking or joining of the first element and the second element in the areas of deformity.

2. The zipper of claim 1 wherein the apertures are formed at periodic intervals.

3. The zipper of claim 1 wherein the apertures are formed at package-width intervals.

4. The zipper of claim 3 wherein the apertures pass through the first element and second element.

5. The zipper of claim 4 wherein the areas of deformity are formed on one side of the apertures.

6. The zipper of claim 5 wherein the areas of deformity are formed by an application of heat.

7. The zipper of claim 5 wherein the areas of deformity are formed by an impact.

8. A combination of:

a zipper moving in a machine direction, the zipper including:

a first profile including a first element;

a second profile including a second element;

wherein the first element can interlock with the second element;

apertures passing through the zipper; and areas of deformity formed adjacent to the apertures wherein the first element and the second element are deformed thereby preventing interlocking or joining of the first element and the second element in the areas of deformity; and a separator extending between the first profile and the second profile, initially in the deformed areas where the first and second elements are not interlocked or joined and then separating the first profile from the second profile in subsequent areas as the zipper moves in the machine direction.

9. The combination of claim 8 wherein the apertures are formed at periodic intervals.

10. The combination of claim 8 wherein the apertures are formed at package-width intervals.

11. The combination of claim 10 wherein the apertures pass through the first element and second element.

12. The combination of claim 11 wherein the areas of deformity are formed on an upstream side of the apertures with respect to a machine direction of travel of the zipper.

13. The combination of claim 12 wherein the areas of deformity are formed by an application of heat.

14. The combination of claim 12 wherein the areas of deformity are formed by an impact.

15. A zipper including:

a first profile including a first flange and a male element;

a second profile including a second flange and a female element;

wherein the male element can interlock with the female element;

apertures passing through the zipper; and areas of deformity formed adjacent to the apertures wherein the male element and the female element are deformed thereby preventing interlocking or joining of the first element and the second element in the areas of deformity.

16. The zipper of claim 15 wherein the apertures are formed at periodic intervals.

17. The zipper of claim 15 wherein the apertures are formed at package-width intervals.

18. The zipper of claim 17 wherein the apertures pass through the male element and female element.

19. The zipper of claim 18 wherein the areas of deformity are formed on one side of the apertures.

20. The zipper of claim 19 wherein the areas of deformity are formed by an application of heat or by an impact.

* * * * *